United States Patent [19]

Goloff

[11] 3,999,906

[45] Dec. 28, 1976

[54] SEALS FOR ROTARY ENGINES

[75] Inventor: Alexander Goloff, East Peoria, Ill.

[73] Assignee: Caterpillar Tractor Co., Peoria, Ill.

[22] Filed: Sept. 22, 1975

[21] Appl. No.: 615,337

[52] U.S. Cl. ..... 418/142; 277/76

[51] Int. Cl.[2] ..... F01C 19/12

[58] Field of Search ..... 418/142; 277/76

[56] References Cited

UNITED STATES PATENTS

| | | | |
|---|---|---|---|
| 3,131,945 | 5/1964 | Scherenberg et al. | 418/142 X |
| 3,176,910 | 4/1965 | Bentele | 418/142 X |
| 3,485,218 | 12/1969 | Clarke | 418/53 |
| 3,834,845 | 5/1973 | Siler | 418/142 |

FOREIGN PATENTS OR APPLICATIONS

| | | | |
|---|---|---|---|
| 1,175,505 | 8/1964 | Germany | 418/142 |

*Primary Examiner*—C. J. Husar
*Assistant Examiner*—Leonard Smith
*Attorney, Agent, or Firm*—Wegner, Stellman, McCord, Wiles & Wood

[57] ABSTRACT

An improved rotary mechanism of the type having elongated seals for sealing the interface between a housing and a rotor mounted for movement therein, the seals being of the type which sealingly engage a relatively movable surface moving in a direction substantially longitudinally of the seals. The seals are provided with a plurality of recesses on both sides of the sealing surface along the length thereof, with the recesses on one side being staggered with respect to the recesses on the other. The sum of the width of adjacent recesses on opposite sides is substantially equal to or greater than the width of the sealing surface of the seal if the recesses were not present.

6 Claims, 6 Drawing Figures

SEALS FOR ROTARY ENGINES

BACKGROUND OF THE INVENTION

This invention relates to rotary mechanisms, and, more particularly, to elongated seals employed in such mechanisms which rub against the surface to be sealed in a direction substantially along their longitudinal extent, such as side seals in trochoidal engines or peripheral seals in slant axis rotary engines.

Prior art of possible relevance includes U.S. Pat. No. 3,834,845, issued to Siler on May 2, 1973.

Elongated seals in rotary mechanisms which rub against the surface to be sealed with a large longitudinal velocity component suffer frequent overheating. Typical of such seals are the end seals employed in trochoidal type mechanisms, oil seals employed in all rotary mechanisms and peripheral seals employed in slant axis rotary mechanisms.

The motion of such seals on the surface to be sealed is not unlike that of an ice skate with the result that a lubricating oil film cannot build up satisfactorily when the rubbing surfaces are extended in the direction of travel. Moreover, because such seals are forced to travel over a previously preheated surface, the heating of which has been caused by the forward portion of the same seal, oil viscosity is decreased thereby thinning the oil film and increasing friction for the trailing part of the seal.

A common consequence is a catastrophic failure due to scuffing of the engaging parts.

Heretofore, to avoid such scuffing, the prior art has resorted to a variety of measures, either singly or in combination. For example, in some cases, engines are derated by decreasing seal speeds to thereby drop the temperature at the rubbing surfaces. Unfortunately, under some conditions, such derating paradoxically decreases the oil film thickness so that the problem is not totally eliminated.

In some cases, an increased amount of oil is directed to the seals to cool the engaging parts and insure adequate lubrication. However, this approach increase oil consumption as well as emissions and is undesirable from these standpoints.

Most frequently, attempts to resolve the difficulty have centered about the use of expensive and exotic materials in the construction of the seals and the surfaces to be sealed.

SUMMARY OF THE INVENTION

It is the principal object of the invention to provide a new and improved seal for use in rotary mechanisms where the seal travels largely along its longitudinal axis. More specifically, it is an object to provide such a seal wherein the sealing engagement with the surface to be sealed is such that a relatively thick oil film can be maintained.

A secondary object of the invention is to provide such a seal that may be effectively gas energized to enhance the sealing ability of such a seal.

The exemplary embodiment of the invention achieves the foregoing object in a rotary mechanism of the type having a housing defining an operating chamber. A rotor is mounted for movement within the chamber and elongated sealing means are disposed on one of the housing and the rotor and include a sealing surface sealingly engaging the other of the housing and the rotor. The elongated sealing means are located such that when the rotor moves within the chamber, the sealing surface of the sealing means will move relative to the surface to be sealed in a direction having a major vector component substantially parallel to the length of the sealing means.

The improved seal embodies a plurality of recesses on both sides of the sealing means and located in the sealing surface along the length thereof. The recesses on one side of the sealing means are staggered with respect to the recesses on the other side. Moreover, the sum of the width of adjacent recesses on opposite sides of the sealing means is substantially equal to or greater than the width of the sealing surface if the recesses were not present.

As a consequence of the foregoing construction, the movement of the sealing surface on the surface to be sealed is at a substantial angle relative to the direction of elongation of the seal thereby effectively eliminating the deleterious "skating" effect of the seal movement on the surface to be sealed.

According to a highly preferred embodiment, the recesses on at least one of the sides of the elongated sealing means terminate short of a surface thereof opposite from the sealing surface, and preferably, the recesses on both sides of the seal terminate short of the surface opposite from the sealing surface.

In a highly preferred embodiment, the sealing surface is configured as a repeating Z-shaped pattern and is thereby configured to urge lubricant in a predetermined direction, preferably into the path of the trailing edge of the seal to insure adequate lubrication therefor.

In general, but not always, according to the invention, the sealing means will be located in a groove on the rotor. When the mechanism is a trochoidal type mechanism, the sealing means will generally comprise side seals or oil seals, while if the mechanism is a slant axis rotary mechanism, the elongated sealing means will comprise peripheral seals or hub seals.

Other objects and advantages will become apparent from the following specification taken in connection with the accompanying drawings.

DESCRIPTION OF THE PREFERRED EMBODIMENTS

Figure 1:
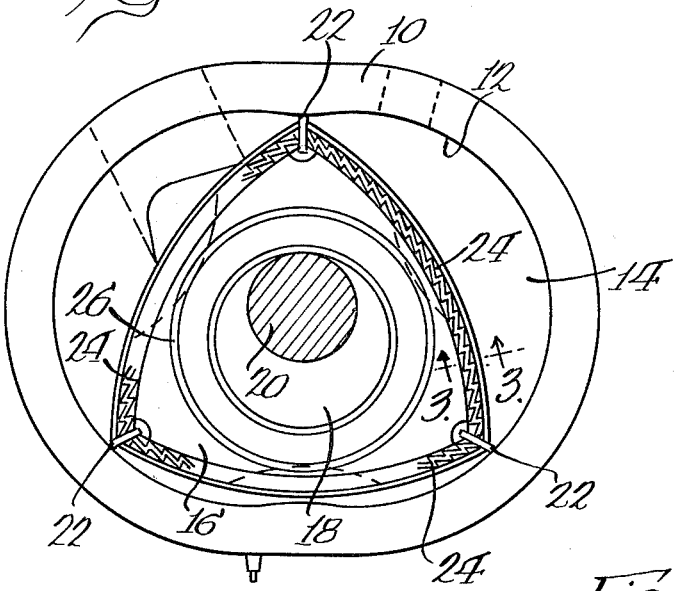
FIG. 1 illustrates a sealing means made according to the invention applied to a trochoidal type rotary mechanism, specifically, a trochoidal rotary engine.
Figure 2:
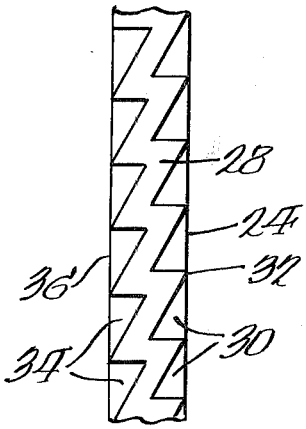
FIG. 2 is an enlarged, fragmentary view of a seal made according to the invention showing the pattern of a sealing surface.
Figure 3:
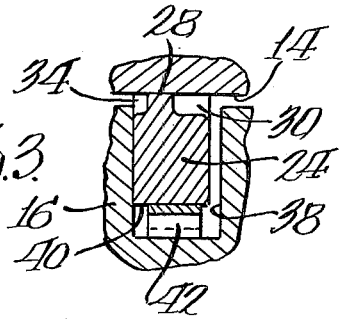
FIG. 3 is a sectional view taken approximately along the line 3—3 of FIG. 1.

One embodiment of a rotary mechanism embodying the invention is illustrated in FIGS. 1–3 in the form of a trochoidal mechanism and, more specifically, in the form of a trochoidal engine. The same includes a center housing 10 having an interior wall 12 which, together with a pair of end housings 14 (only one of which is shown), defines an operating chamber. Within the chamber thus defined is a rotor 16 journalled on a conventional eccentric 18 forming part of a shaft 20. At each of the apices of the rotor 16, apex seals 22 are provided while both sides of the rotor 16 are provided with end seals 24 and oil seals 26.

Those skilled in the art will immediately recognize that both the end seals 24 and the oil seals 26 carried by the rotor 16 sealingly engage the corresponding one of the end housings 14 and move relative thereto in a direction having a major vector component substantially parallel to any given portion of their length. That is, the relative motion between such seals and the surface to be sealed is not unlike that of an ice skate on ice. (Obviously, an identical relationship is not present by reason of the fact that in normal construction of such mechanisms, such seals, while elongated, are not straight. Similarly, an identical relationship will not be present due to the path of movement of the rotor 16 within the operating chamber.)

As a consequence of this relationship, the trailing edge of, for example, one of the seals 24, will pass over a portion of the end housing 14 that has already been preheated to some degree by the leading edge of the same seal. Because of such heating, the viscosity of lubricating oil will be decreased with the result that the oil film will be thinner at a given point when the trailing edge of the seal reaches that point than it was when first contacted by the leading edge of the seal. Thus, for such seal movements, there is a great tendency to scuff even though, in a typical trochoidal type mechanism, contact stresses between the seals and the surface to be sealed are very low.

The invention solves this difficulty by configuring the sealing surface of the seal such that a given point on the surface to be sealed is not continually contacted by the sealing surface of the seal over any significant portion of the length of the seal. With reference to FIG. 2, one of the seals 24 is illustrated and has a sealing surface 28 configured as a repeating Z-shaped pattern. Stated another way, a plurality of recesses 30 are located along the length of the seal 24 in one of the sides 32 thereof while a plurality of recesses 34 are located in the opposite side 36 of the seal 24 along the length thereof and in staggered relation to the recesses 30. As illustrated in FIG. 2, the recesses 30 have a width equal to half the width of the seal 24, while the recesses 34 have a similar width. In this connection, it is not required that the recesses on opposite sides of the seal have identical widths. Rather, it is necessary that the sum of the widths of adjacent recesses on opposite sides of the seal be equal to or greater than the width of the sealing surface 28 if the recesses were not present. In this way, a given point on the surface to be sealed will be repeatedly passed over by the recesses 30 and 34 in alternating fashion. When such occurs, there will be no contact with the sealing surface 28 and, accordingly, there will be no friction to generate heat that would reduce the viscosity of the oil, resulting in a thinning of the oil film.

The seals 24 are disposed in grooves 38 in the sides of the rotor 16 and include a surface 40 opposite from the sealing surface 28. Typically, a biasing means, such as an undulating spring 42, will be disposed in the groove 38 to bias the seal 24 outwardly into engagement with the surface to be sealed.

Generally, for the purpose of achieving economical manufacture, the configuration of the seals 24 adjacent the surface 40 will be uniform along the length thereof. That is, the recesses 30 and 34 will not extend along the sides of the seal 24 to the surface 40. However, where economics of manufacture are not of great concern, the seal from the surface 28 to the surface 40 may have the same configuration as the surface 28, it being understood that a mating configuration of the groove 38 will be required in such a case.

A sealing surface configuration such as that illustrated at 28 in FIG. 2 is but one example of the implementation of the invention. For example, the Z-shaped pattern is illustrated as having a portion transverse to the length of the seal. Such a portion, however, may have a negative or positive slope as desired.

It should also be appreciated that the use of a Z-shaped pattern, whether of the type illustrated or having positive or negative slopes, can be employed to advantageously direct oil along the surface to be sealed to desired locations. For example, if the configuration illustrated in FIG. 2 is employed, for relative motion in a downward direction, lubricant will be moved to the right off the seal 24, while for upward movement, lubricant would be moved to the left of the seal. Thus, in a trochoidal type mechanism, where the trailing portion of an end seal tends to move progressively radially outwardly on the end housing 14 during rotation of the rotor 16, use of the configuration illustrated in FIG. 2, as applied to FIG. 1, will result in those portions of the seal 24, from the midpoint thereon, directing lubricant radially outwardly to be encountered by progressively trailing portions of the seal to insure good lubrication thereof.

Generally, the leading portions of such a seal, i.e., those extending from an apex to approximately the midpoint of the seal, receive sufficient lubrication so that such lubricant direction is not necessary. However, in those instances where additional lubrication may be required, the invention contemplates one pattern designed to direct lubricant in one direction on one part of a seal and another pattern designed to direct lubricant in an opposite direction, on the remaining portion of the seal.

Figure 4:
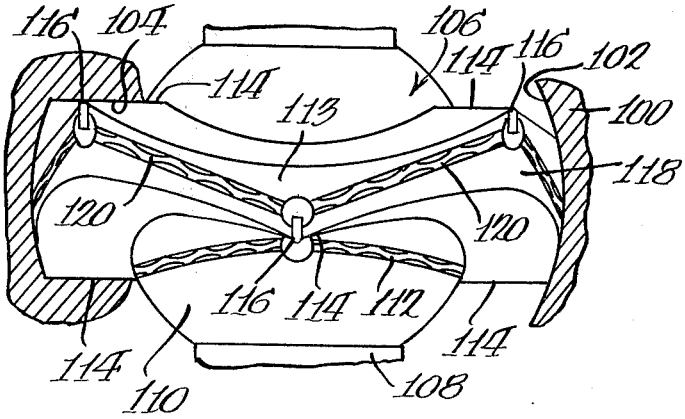
FIG. 4 illustrates a modified embodiment of a seal made according to the invention applied to a slant axis rotary mechanism.

The invention is applicable to a variety of rotary mechanisms and is not limited to the trochoidal type mechanism illustrated in FIG. 1. With reference to FIG. 4, the same is seen applied to a slant axis rotary mechanism. The slant axis rotary mechanism includes a casing 100 having an interior surface 102 formed of a section of a sphere and undulating side walls 104, as is well known. The surface 102 and side walls 104 define an operating chamber for a rotor, generally designated 106, which is journalled on an angularly offset portion 108 of a shaft.

The rotor 106 includes a radially inner spherical section 110 which may be provided with seals 112 for sealing engagement with a generally mating portion of the housing 100 (not shown). The rotor also includes a radially outer, undulating peripheral web 113 provided with a plurality of apices 114 which are provided with apex seals 116 which sealingly engage the undulating side walls 104. The number of the apices 114 and the precise configuration of the web 113 is, of course, dependent upon the nature of the mechanism, i.e., whether it is two-cycle mechanism, a four-cycle mechanism, etc.

Figure 6:
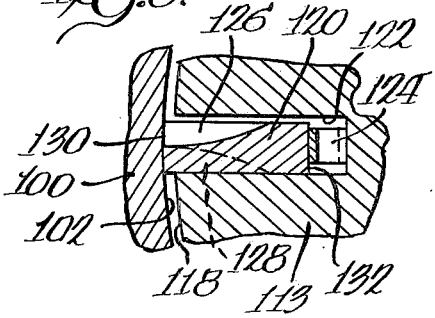
FIG. 6 is a sectional view taken approximately along the line 6—6 of FIG. 5.
Figure 5:
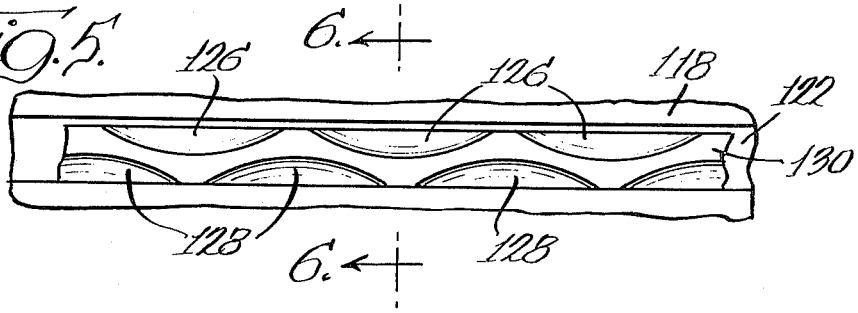
FIG. 5 is an enlarged, fragmentary view of the seal employed in the embodiment of FIG. 4.

On the radially outer peripheral surface 118 of the web 113 there are provided a plurality of elongated seals 120 which sealingly engage the surface 102. As best seen in FIGS. 5 and 6, the rotor surface 118 is provided with grooves 122 for receipt of the seals 120 and an appropriate undulating biasing spring 124.

The seals 112 and 120 are provided with a plurality of recesses 126 on one side thereof along the length of each seal. In staggered relation, on the opposite side, are a plurality of recesses 128. And, as seen in FIG. 6, the recesses are located in the sealing surface 130 of the seals and extend only partially to the opposite surface 132. Again, it will be observed that the sum of the width of one of the recesses 126 and one of the recesses 128 is equal to or greater than the width of the sealing surface 130 if the recesses were not present.

The presence of the recesses 126 and 128 operates to minimize friction and thereby minimize heating which would thin the oil to the point where adequate lubrication cannot be had. In addition, the recesses 126 and 128 assist in gas energizing the seals in terms of providing a less restricted path for the entry of gas into the groove 122 to the area of the spring 124 where it may act against the surface 132 of the seal. In this respect, those skilled in the art will recognize that when a slant axis rotary mechanism, such as the mechanism illustrated in FIG. 4 is employed as an internal combustion engine, combustion will occur on both sides of the web 113 with the consequence that the seals 120 require gas energization from both sides at differing points in the engine cycle. The presence of the recesses 126 and 128 on both sides of the seal 120 enhance gas energization of the seal from both sides as well as provide for better oil film maintenance.

While the invention has been described in connection with compression seals, such as the side seals of a trochoidal type engine, or the peripheral seals of a slant axis rotary mechanism, it will be recognized that it is applicable to similar seals in a variety of rotary mechanisms and is not necessarily limited to engines. It will also be appreciated that seals made according to the invention may be advantageously employed as oil seals as well.

What is claimed is:

1. In a rotary mechanism having a housing defining an operating chamber, a rotor mounted for movement within the chamber, elongated sealing means on one of said housing and said rotor and having a sealing surface sealingly engaging the other of said housing and said rotor, and wherein said sealing means are located on said one of said housing and said rotor such that when said rotor moves within said chamber said sealing surface will move relative to said other of said housing and said rotor in a direction having a major vector component substantially parallel to the length of said sealing means, the improvement comprising:

a plurality of recesses on both sides of said sealing means in said sealing surface and along the length thereof, the recesses on one side being staggered, in overlapping relation, with respect to the recesses on the other side, the sum of the widths of adjacent recesses on opposite sides of said sealing means being substantially equal to or greater than the width of said sealing surface if the recesses were not present.

2. The rotary mechanism of claim 1 wherein said sealing surface is configured as a repeating Z-shaped pattern.

3. The rotary mechanism of claim 1 wherein sides of said recesses on at least one side of said sealing means are configured to urge lubricant in a predetermined direction.

4. The rotary mechanism of claim 1 wherein said recesses include a side on at least one side of the sealing means sloped with respect to the length of the seal for directing lubricant in a predetermined direction generally radially of said seal.

5. The rotary mechanism of claim 1 wherein said elongated sealing means includes a surface opposite of said sealing surface, said recesses on at least one of said sides terminating short of said opposite surface.

6. The rotary mechanism of claim 5 wherein the recesses on both said sides terminate short of said opposite surface.

* * * * *